US011092170B2

(12) United States Patent
Poon et al.

(10) Patent No.: US 11,092,170 B2
(45) Date of Patent: Aug. 17, 2021

(54) DUAL VALVE FLUID ACTUATOR ASSEMBLY

(71) Applicant: NIKON CORPORATION, Tokyo (JP)

(72) Inventors: Alex Ka Tim Poon, San Ramon, CA (US); Yeong-Jun Choi, San Ramon, CA (US); Pai-Hsueh Yang, Palo Alto, CA (US); Sandy Lee, Dublin, CA (US); Gaurav Keswani, Foster City, CA (US); Rocky Mai, San Mateo, CA (US)

(73) Assignee: NIKON CORPORATION

( * ) Notice: Subject to any disclaimer, the term of this patent is extended or adjusted under 35 U.S.C. 154(b) by 0 days.

(21) Appl. No.: 16/485,406

(22) PCT Filed: Feb. 12, 2018

(86) PCT No.: PCT/US2018/017868
§ 371 (c)(1),
(2) Date: Aug. 12, 2019

(87) PCT Pub. No.: WO2018/152069
PCT Pub. Date: Aug. 23, 2018

(65) Prior Publication Data

US 2019/0376531 A1 Dec. 12, 2019

Related U.S. Application Data

(60) Provisional application No. 62/459,516, filed on Feb. 15, 2017.

(51) Int. Cl.
*F15B 9/08* (2006.01)
*F15B 9/03* (2006.01)
(Continued)

(52) U.S. Cl.
CPC ..... *F15B 9/08* (2013.01); *F15B 9/03* (2013.01); *F15B 11/006* (2013.01);
(Continued)

(58) Field of Classification Search
CPC ..... F15B 9/08; F15B 2211/40507; F15B 11/028; F15B 11/042; F15B 2211/351; F15B 2211/353
See application file for complete search history.

(56) References Cited

U.S. PATENT DOCUMENTS 4,763,560 A 8/1988 Sasaki
7,896,102 B2 3/2011 Hirling et al.
(Continued)

FOREIGN PATENT DOCUMENTS

CN 109477501 A 3/2019
DE 112007003562 T5 5/2010
(Continued)

OTHER PUBLICATIONS

International Search Report and Written Opinion dated Apr. 30, 2018 in PCT/US2018/017868.
(Continued)

*Primary Examiner* — Abiy Teka
(74) *Attorney, Agent, or Firm* — Roeder & Broder LLP; Steven G. Roeder

(57) ABSTRACT

A stage assembly (10) includes a stage (14), and a fluid actuator assembly (24) that moves the stage (14). The fluid actuator assembly (24) includes a piston housing (32) that defines a piston chamber (34); (ii) a piston (36) that separates the piston chamber (34) into a first chamber (34A) and a second chamber (34B); (iii) a supply valve (38C) that controls the flow of the working fluid (40) into the first chamber (34A); and (iv) an exhaust valve (38D) that controls the flow of the working fluid (40) out of the first chamber (34A). The supply valve (38C) has a supply orifice (250G) having a supply orifice area, and the exhaust valve (38D) has an exhaust orifice (352G) having an exhaust orifice area. Moreover, the supply orifice area is different from the exhaust orifice area. Further multiple valves of
(Continued)

different sizes can be used in combination for the supply and exhaust for each chamber (34A), (34B).

21 Claims, 9 Drawing Sheets

(51) Int. Cl.
*F15B 11/00* (2006.01)
*F15B 11/028* (2006.01)
*F15B 11/042* (2006.01)
*F15B 13/04* (2006.01)

(52) U.S. Cl.
CPC ..... *F15B 11/028* (2013.01); *F15B 11/042* (2013.01); *F15B 13/0405* (2013.01); *F15B 2013/041* (2013.01); *F15B 2211/30575* (2013.01); *F15B 2211/31* (2013.01); *F15B 2211/351* (2013.01); *F15B 2211/353* (2013.01); *F15B 2211/6313* (2013.01)

(56) References Cited

U.S. PATENT DOCUMENTS

| | | | | |
|---|---|---|---|---|
| 2002/0085192 | A1 | 7/2002 | Mura et al. | |
| 2004/0261608 | A1 | 12/2004 | Bugel et al. | |
| 2005/0140946 | A1 | 6/2005 | Tsuji et al. | |
| 2007/0131879 | A1* | 6/2007 | Poon | G03F 7/70758 250/492.2 |
| 2011/0017310 | A1 | 1/2011 | Eriksson | |
| 2012/0073431 | A1 | 3/2012 | Ikonen et al. | |
| 2015/0298730 | A1 | 10/2015 | Wiktor et al. | |
| 2017/0051629 | A1 | 2/2017 | Sutherland | |

FOREIGN PATENT DOCUMENTS

| | | | |
|---|---|---|---|
| EP | 0828946 | A1 | 3/1998 |
| EP | 2933387 | A1 | 10/2015 |
| GB | 2038417 | A | 7/1980 |
| GB | 2140871 | A | 12/1984 |
| WO | WO9607029 | A1 | 3/1996 |
| WO | WO2004065798 | A1 | 8/2004 |
| WO | WO2017210450 | A1 | 12/2017 |

OTHER PUBLICATIONS

Search Report issued in EPO Application Serial No. 18754320.2, by the European Patent Office dated Nov. 16, 2020.
Office Action issued by the China National Intellectual Property Administration in Application Serial No. 201880019603.2, dated Apr. 12, 2021.

* cited by examiner

DUAL VALVE FLUID ACTUATOR ASSEMBLY

RELATED APPLICATION

This application claims priority on U.S. Provisional Application Ser. No. 62/459,516 filed on Feb. 15, 2017 and entitled "DUAL VALVE FLUID ACTUATOR ASSEMBLY". As far as permitted, the contents of U.S. Provisional Application Ser. No. 62/459,516 is incorporated herein by reference.

BACKGROUND

Exposure apparatuses are commonly used to transfer images from a mask onto a workpiece such as an LCD flat panel display or a semiconductor wafer. A typical exposure apparatus includes an illumination source, a mask stage assembly that retains and precisely positions a mask, a lens assembly, a workpiece stage assembly that retains and precisely positions the workpiece, and a measurement system that monitors the position or movement of the mask and the workpiece. There is a never ending desire to reduce the cost of the actuators used to position the mask and/or the workpiece, while still accurately positioning these components.

SUMMARY

The present invention is directed to stage assembly for positioning a workpiece along a movement axis. In one embodiment, the stage assembly includes a stage, a base, a fluid actuator assembly, and a control system. The stage that is adapted to retain the workpiece. The fluid actuator assembly is coupled to and moves the stage along the movement axis relative to the base. The fluid actuator assembly can include (i) a piston housing that defines a piston chamber; (ii) a piston that is positioned within and moves relative to the piston chamber along a piston axis, the piston separating the piston chamber into a first chamber and a second chamber that are on opposite sides of the piston; and (iii) a first valve sub-assembly that controls the flow of a working fluid into the first chamber. The first valve sub-assembly can include a first supply valve that controls the flow of the working fluid into the first chamber, and a first exhaust valve that controls the flow of the working fluid out of the first chamber. Further, the first supply valve has a first supply orifice having a first supply orifice area, and the first exhaust valve has a first exhaust orifice having a first exhaust orifice area. Moreover, the first supply orifice area is different from the first exhaust orifice area. The control system controls the valve assembly to control the flow of the working fluid into and out of the first chamber.

For example, the working fluid is a gas, and the present invention is described as a pneumatic control application. Alternatively, the working fluid can be a liquid such as oil, or another type of liquid.

In one embodiment, the first exhaust orifice area is larger than the first supply orifice area. For example, the first exhaust orifice area can be at least ten percent larger than the first supply orifice area. With this design, the larger exhaust valve will allow for the working fluid to be removed from the first chamber faster. With the present design, the inlet and outlet valve size can be selected based on the velocity/acceleration requirement of the system. Typically, exhaust valve is a limiting factor and it causes back pressure in the chamber. As a result thereof, the exhaust orifice area can be designed to be larger than the supply orifice area.

Additionally, the fluid actuator assembly can include a second valve sub-assembly that controls the flow of the working fluid into and out of the second chamber. In this embodiment, the second valve sub-assembly includes a first supply valve that controls the flow of the working fluid into the second chamber, and a first exhaust valve that controls the flow of the working fluid out of the second chamber. Further, the first supply valve has a first supply orifice having a first supply orifice area, and the first exhaust valve has a first exhaust orifice having a first exhaust orifice area. Moreover, the first exhaust orifice area can be larger than the first supply orifice area. For example, for the second valve sub-assembly, the first exhaust orifice area can be at least ten percent larger than the first supply orifice area.

In another embodiment, the first valve sub-assembly includes a second supply valve that controls the flow of the working fluid into the first chamber, and the second supply valve has a second supply orifice having a second supply orifice area. Further, the second supply orifice area can be larger than the first supply orifice area. In this design, the first supply valve can be used for fine adjustments to the pressure in the first chamber while the second supply valve can be used for coarse adjustments to the pressure in the first chamber. It should be noted that if a suitable second supply valve with a large enough supply orifice is not available, then multiple, smaller, second supply valves can be used as needed. In certain embodiments, (i) the multiple, second supply valves can be used in conjunction with the first supply valve for coarse supply adjustment; and (ii) and the one, first supply valve can be used for fine adjustments.

Additionally, or alternatively, the first valve sub-assembly can include a second exhaust valve that controls the flow of the working fluid out of the first chamber, the second exhaust valve having a second exhaust orifice having a second exhaust orifice area. In this embodiment, the second exhaust orifice area can be larger than the first exhaust orifice area. In this design, the first exhaust valve can be used for fine adjustments to the pressure in the first chamber while the second exhaust valve can be used for coarse adjustments to the pressure in the first chamber. It should be noted that if a suitable second exhaust valve with a large enough exhaust orifice is not available, then multiple, smaller, second exhaust valves can be used as needed. In certain embodiments, (i) the multiple, second exhaust valves can be used in conjunction with the first exhaust valve for coarse exhaust adjustment; and (ii) and the one, first exhaust valve can be used for fine adjustments.

The present invention is also directed to a method for positioning a workpiece along a movement axis. The method can include providing a base; coupling the workpiece to a stage; moving the stage along the movement axis relative to the base with a fluid actuator assembly; and controlling the fluid actuator assembly with a control system. In this embodiment, the fluid actuator assembly can include (i) a piston housing that defines a piston chamber; (ii) a piston that is positioned within and moves relative to the piston chamber along a piston axis, the piston separating the piston chamber into a first chamber and a second chamber that are on opposite sides of the piston; and (iii) a first valve sub-assembly that controls the flow of a working fluid into the first chamber. The first valve sub-assembly can include a first supply valve that controls the flow of the working fluid into the first chamber, and a first exhaust valve that controls the flow of the working fluid out of the first chamber. The first supply valve has a first supply orifice having a first supply orifice area, and the first exhaust valve has a first exhaust orifice having a first exhaust orifice area. Further, the first supply orifice area can be different from the first exhaust orifice area.

The present invention is also directed to an exposure apparatus, and a process for manufacturing a device that includes the steps of providing a substrate and forming an image to the substrate with the exposure apparatus.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1:
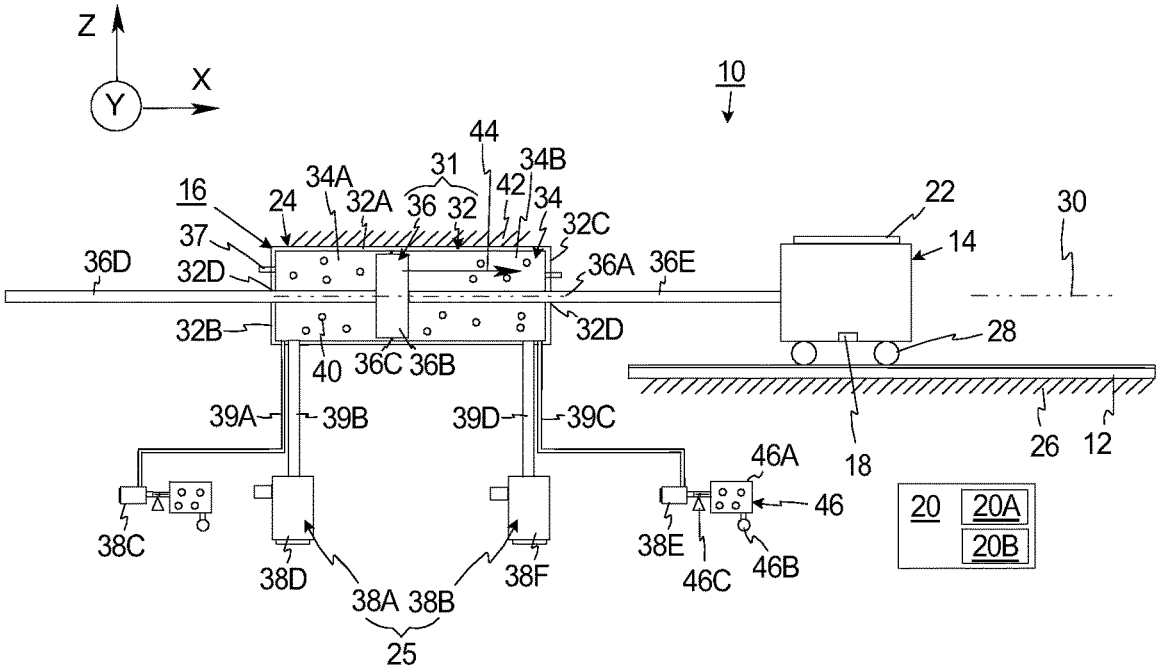
FIG. 1 is a simplified side illustration of a first embodiment of a stage assembly having features of the present invention.

FIG. 1 is a simplified illustration of a stage assembly 10 that includes a base 12, a stage 14, a stage mover assembly 16, a measurement system 18, and a control system 20 (illustrated as a box). The design of each of these components can be varied to suit the design requirements of the stage assembly 10. The stage assembly 10 is particularly useful for precisely positioning a workpiece 22 (also sometimes referred to as a device) during a manufacturing and/or an inspection process.

As an overview, in certain embodiments, the stage mover assembly 16 includes a fluid actuator assembly 24 that is relatively inexpensive to manufacture. Further, the fluid actuator assembly 24 includes a unique valve assembly 25 that enhances the performance of the fluid actuator assembly 24. With this design, the control system 20 can control the fluid actuator assembly 24 to accurately and rapidly position the workpiece 22. As a result thereof, the stage assembly 10 is less expensive to manufacture and the workpiece 22 is still positioned with the desired level of accuracy.

The type of workpiece 22 positioned and moved by the stage assembly 10 can be varied. For example, the workpiece 22 can be an LCD flat panel display, a semiconductor wafer, or a mask, and the stage assembly 10 can be used as part of an exposure apparatus. Alternatively, for example, the stage assembly 10 can be used to move other types of devices during manufacturing and/or inspection, to move a device under an electron microscope (not shown), or to move a device during a precision measurement operation (not shown).

Some of the Figures provided herein include an orientation system that designates an X axis, a Y axis, and a Z axis. It should be understood that the orientation system is merely for reference and can be varied. For example, the X axis can be switched with the Y axis and/or the stage assembly 10 can be rotated. Moreover, these axes can alternatively be referred to as a first, second, or third axis.

The base 12 supports the stage 14. In the non-exclusive embodiment illustrated in FIG. 1, the base 12 is rigid and generally rectangular plate shaped. Further, the base 12 can be fixedly secured to a base mount 26. Alternatively, the base 12 can be secured to another structure.

The stage 14 retains the workpiece 22. In one embodiment, the stage is precisely moved by the stage mover assembly 16 relative to the base 12 to precisely position the stage 14 and the workpiece 22. In FIG. 1, the stage 14 is generally rectangular shaped and includes a device holder (not shown) for retaining the workpiece 22. The device holder can be a vacuum chuck, an electrostatic chuck, or some other type of clamp that directly couples the workpiece 22 to the stage 14. In the embodiments illustrated herein, the stage assembly 10 includes a single stage 14 that retains the workpiece 22. Alternately, for example, the stage assembly 10 can be designed to include multiple stages that are independently moved and positioned. As an example, the stage assembly 10 can include a fine stage (not shown) that retains the workpiece 22 and that is moved relative to the coarse stage 14 with a fine stage mover assembly (not shown).

Further, in FIG. 1, the stage 14 can be supported relative to the base 12 with a bearing assembly 28 that allows the movement of the stage 14 relative to the base 12. For example, the bearing assembly 28 can be a roller bearing, a fluid bearing, a linear bearing, or another type of bearing.

The measurement system 18 monitors the movement and/or the position of the stage 14 relative to a reference, such as an optical assembly (not shown in FIG. 1) or the base 12 and provides measurement information to the control system 20. With this information, the stage mover assembly 16 can be controlled with the control system 20 to precisely position the stage 14. The design of the measurement system 18 can be varied according to the movement requirements of the stage 14. In one embodiment, the measurement system 18 can include a linear encoder that monitors movement of the stage 14 along the Y axis. Alternatively, the measurement system 18 can include an interferometer, or another type of movement or position sensor.

The stage mover assembly 16 is controlled by the control system 20 to move the stage 14 relative to the base 12. In FIG. 1, the stage mover assembly 16 includes the fluid actuator assembly 24 that moves the stage 14 along a single movement axis 30, e.g. the Y axis.

The design of the fluid actuator assembly 24 can be varied pursuant to the teachings provided herein. In one, non-exclusive embodiment, the fluid actuator assembly 24 includes (i) a piston assembly 31 that includes a piston housing 32 that defines a piston chamber 34, and a piston 36 positioned in the piston chamber 34; and (ii) the valve assembly 25 that controls the flow of a working fluid 40 (illustrated as small circles) into and out of the piston chamber 34. For example, the working fluid 40 can be air or another type of fluid. The design of these components can be varied pursuant to the teaching provided herein.

In one embodiment, the piston housing 32 is rigid and defines a generally right, cylindrically shaped piston chamber 34. In this embodiment, the piston housing 32 includes a tubular shaped side wall 32A; a disk shaped, first end wall 32B, and a disk shaped, second end wall 32C that is spaced apart from the first end wall 32B. One or both end walls 32B, 32C can include a wall aperture 32D for receiving a portion of the piston 36.

The piston housing 32 can be fixedly secured to a piston mount 42. Alternatively, the piston housing 32 can be secured to another structure, such as the base 12. Still alternatively, because the piston housing 32 receives the reaction forces generated by the stage mover assembly 16, the piston housing 32 can be coupled to a reaction assembly that counteracts, reduces and minimizes the influence of the reaction forces from the stage mover assembly 16 on the position of other structures. For example, the piston housing 32 can be coupled to a large countermass (not shown) that is maintained above a countermass support (not shown) with a reaction bearing (not shown) that allows for motion of the piston housing 32 along the movement axis 30.

The piston 36 is positioned within and moves relative to the piston chamber 34 along a piston axis 36A. In certain embodiments, the piston axis 36A is coaxial with the movement axis 30. In the non-exclusive embodiment illustrated in FIG. 1, the piston 36 includes (i) a rigid, disk shaped piston body 36B, (ii) a piston seal 36C that seals the area between the piston body 36B and the piston housing 32, (iii) a rigid, first beam 36D that is attached to and cantilevers away from the piston body 36B, and extends through the wall aperture 32D in the first end wall 32B, (iv) a rigid, second beam 36E that is attached to and cantilevers away from the piston body 36B, and extends through the wall aperture 32D in the second end wall 32C, (iv) a first beam seal (e.g. an O-ring type seal, not shown) that seals the area between the first beam 36D and the first end wall 32B, and (v) a second beam seal (e.g. an O-ring type seal, not shown) that seals the area between the second beam 36E and the second end wall 32C.

In this embodiment, the second beam 36E is also fixedly secured to the stage 14. Stated in another fashion, the second beam 36E extends between the piston body 36B and the stage 14 so that movement of the piston body 36B results in movement of the stage 14. Alternatively, for example, the fluid actuator assembly 24 can be designed without the first beam 36D. In this design, the effective area on the left of the piston body 36B is greater than the right side.

The piston body 36B separates the piston chamber 34 into a first chamber 34A (also referred to a "chamber one") and a second chamber 34B (also referred to a "chamber two") that are on opposite sides of the piston body 36B. In FIG. 1, the first chamber 34A is on the left side of the piston body 36B and the second chamber 34B is on the right side of the piston body 36B. Further, the first chamber 34A has a chamber one effective piston area ($A_1$), and is filled with the working fluid 40 that is at a first pressure ($P_1$), at a first temperature ($T_1$), and has a first volume ($V_1$). Similarly, the second chamber 34B has a chamber two effective piston area ($A_2$), and is filled with the working fluid 40 that is at a second pressure ($P_2$), at a second temperature ($T_2$), and has a second volume ($V_2$). It should be noted that the working fluid 40 used in the first chamber 34A can be similar or different in composition from the working fluid 40 used in the second chamber 34B.

In the non-exclusive example illustrated in FIG. 1, the fluid actuator assembly 24 is designed so that the chamber 1 effective piston area ($A_1$) is approximately equal to the chamber 2 effective piston area ($A_2$).

The first pressure ($P_1$) of the working fluid 40 in the first chamber 34A generates a first force ($F_1$) on the piston body 36B, and the second pressure ($P_2$) of the working fluid 40 in the second chamber 34B generates a second force ($F_2$) on the piston body 36B. A total force (F) 44 (illustrated by an arrow) generated by the fluid actuator assembly 24 is equal to the first force ($F_1$) minus the second force ($F_2$) (($F=F_1-F_2$). In certain embodiments, the piston assembly 31 can include one or more pressure sensors 37 that provide feedback regarding the pressure in the respective chamber 34A, 34B to the control system 20.

With the non-exclusive design illustrated in FIG. 1, when the first pressure ($P_1$) is greater than the second pressure ($P_2$), the first force ($F_1$) is greater than the second force ($F_2$), the total force (F) is positive and urges the piston body 36B and the stage 14 from left to right. In contrast, when the first pressure ($P_1$) is lesser than the second pressure ($P_2$), the first force ($F_1$) is less than the second force ($F_2$), the total force (F) is negative, and urges the piston body 36B and the stage 14 from right to left.

In one embodiment, the valve assembly 25 is controlled by the control system 20 to accurately and individually control the pressure in each chamber 34A, 34B. As one, non-exclusive embodiment, the valve assembly 25 includes (i) a first (chamber one) valve sub-assembly 38A that is controlled to control the flow of the working fluid 40 into and out of the first chamber 34A and accurately control the first pressure ($P_1$); and (ii) a second (chamber two) valve sub-assembly 38B that is controlled to control the flow of the working fluid 40 into and out of the second chamber 34B, to accurately control the second pressure ($P_2$).

In this embodiment, the first valve sub-assembly 38A includes a first supply valve 38C that is controlled to control the flow of the working fluid 40 into the first chamber 34A, and a first exhaust valve 38D that is controlled to control the flow of the working fluid 40 out of the first chamber 34A. Further, the first supply valve 38C is connected in fluid communication to the first chamber 34A via a first supply conduit 39A, and the first exhaust valve 38D is connected in fluid communication to the first chamber 34A via a first exhaust conduit 39B.

Similarly, the second valve sub-assembly 38B includes a second supply valve 38E that is controlled to control the flow of the working fluid 40 into the second chamber 34B, and a second exhaust valve 38F that is controlled to control the flow of the working fluid 40 out of the second chamber 34B. Further, the second supply valve 38E is connected in fluid communication to the second chamber 34B via a second supply conduit 39C, and the second exhaust valve 38F is connected in fluid communication to the second chamber 34B via a second exhaust conduit 39D.

In this embodiment, the fluid actuator assembly 24 can include one or more fluid pressure sources 46 (two are shown) that provide pressurized working fluid 40 to the supply valves 38C, 38E. Moreover, each of the fluid pressure sources 46 can include a fluid tank 46A, a compressor 46B that generates the pressurized working fluid 40 in the tank 46A, and a pressure regulator 46C that controls the pressure of the working fluid 40 delivered to the supply valves 38C, 38E. Further, the exhaust valves 38D, 38F can vent to the atmosphere or to a low pressure area, such as a vacuum chamber.

As provided in more detail below, the valves 38C, 38D, 38E, 38F are designed to improve the speed and accuracy of the fluid actuator assembly 24. The type of valve 38C, 38D, 38E, 38F utilized can be varied. As non-exclusive examples, each valve 38C, 38D, 38E, 38F can be a two-way proportional valve such as a poppet ("mushroom") type valve or a spool-type valve.

The control system 20 controls the valve assembly 25 to control the flow of the working fluid 40 into and out of each chamber 34A, 34B. By selectively controlling the flow of the working fluid 40 into and out of each chamber 34A, 34B, the valve assembly 25 can be controlled to generate the controllable force 44 ("F") on the piston body 36B that accurately moves the piston body 36B and the stage 14.

The control system 20 is electrically connected to, and controls the electrical current that is directed to the valve assembly 25 to precisely position the stage 14 and the workpiece 22. In one embodiment, the control system 20 uses the information from the measurement system 18 (i) to constantly determine the position of the stage 14 along the X axis; and (ii) to direct current to the valve assembly 25 to position the stage 14. The control system 20 can include one or more processors 20A and electronic data storage 20B. The control system 20 uses one or more algorithms to perform the steps provided herein.

In certain embodiments, the control system 20 individually controls each of the first valves 38C, 38D to control the first pressure ($P_1$) in the first chamber 34A to generate the desired first force ($F_1$). Similarly, the control system 20 individually controls each of the second valves 38E, 38F to control the second pressure ($P_2$) in the second chamber 34B to generate the desired second force ($F_2$). Thus, by controlling the valves 38C, 38D, 38E, 38F, the control system 20 can control the fluid actuator assembly 24 to generate the desired total force (F) 44 on the stage 14.

In certain embodiments, when the control system 20 determines the need to add working fluid 40 to the first chamber 34A, the control system 20 controls the first exhaust valve 38D to be closed, and the first supply valve 38C to open the appropriate amount to add the working fluid 40. Further, when the control system 20 determines the need to remove working fluid 40 from the first chamber 34A, the control system 20 controls the first supply valve 38C to be closed, and the first exhaust valve 38C to open the appropriate amount to release the working fluid 40. In this example, one of the first valves 38C, 38D is controlled to be closed at any given time. Alternatively, the control system 20 can control both first valves 38C, 38D to be open during adding and/or removing working fluid 40 from the first chamber 34A.

Similarly, when the control system 20 determines the need to add working fluid 40 to the second chamber 34B, the control system 20 controls the second exhaust valve 38F to be closed, and the second supply valve 38E to open the appropriate amount to add the working fluid 40. Further, when the control system 20 determines the need to remove working fluid 40 from the second chamber 34B, the control system 20 controls the second supply valve 38E to be closed, and the second exhaust valve 38F to open the appropriate amount to release the working fluid 40. In this example, one of the second valves 38E, 38F is controlled to be closed at any given time. Alternatively, the control system 20 can control both second valves 38E, 38F to be open during adding and/or removing working fluid 40 from the second chamber 34B.

Figure 2A:
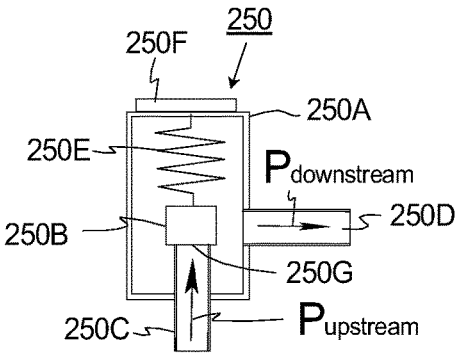
FIG. 2A is simplified cut-away view of one, non-exclusive example of a supply valve having features of the present invention in a closed position.
Figure 2B:
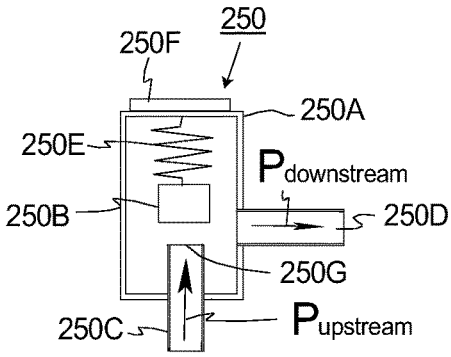
FIG. 2B is simplified cut-away view of the supply valve of FIG. 2A in an open position.

FIG. 2A is simplified cut-away view of one, non-exclusive example of a supply valve 250 in a closed position, and FIG. 2B is a simplified cut-away view of the supply valve 250 of FIG. 2A in an open position. The supply valve 250 can be used as the first supply valve 38C of the first valve sub-assembly 38A, and/or the second supply valve 38E of the second valve sub-assembly 38B of FIG. 1. In this embodiment, the supply valve 250 is a poppet type valve that includes a valve housing 250A, a movable valve body 250B, an inlet conduit 250C, an outlet conduit 250D, a resilient member 250E (e.g. a spring) that urges the valve body 250B against the inlet conduit 250C, and a solenoid 250F.

In this simplified example, the valve housing 250A is somewhat cylindrical shaped, the valve body 250B is disk shaped, and the conduits 250C, 250D are tubular shaped. Further, in FIG. 2A, the valve 250 is illustrated in the closed position when the control system (not shown in FIG. 2A) is not directing current to the solenoid 250F. As a result thereof, the resilient member 250E urges the valve body 250B against the top of the inlet conduit 250C to close the valve 250. It should be noted that when no current is directed to the solenoid 250F, the valve remains closed as long as the spring preload force is greater than the force generated by the pressure difference between the pressure upstream and the pressure downstream.

Alternatively, in FIG. 2B, the valve 250 is illustrated in the open position when the control system (not shown in FIG. 2B) is directing current to the solenoid 250F. In this embodiment, current directed to the solenoid generates a solenoid force that urges (attracts) the valve body 250B upward away from the top of the inlet conduit 250C. Typically, the magnitude of solenoid force is proportional to the current. When sufficient current is directed to the solenoid 250F, the spring preload force of the resilient member 250F is overcome, the valve body 250B is moved away from the top of the inlet conduit 250C, and the valve 250 is opened. Further, the amount of current will determine how far the valve 250 is opened. Generally, the size of the valve opening increases as current increases.

Figure 2C:
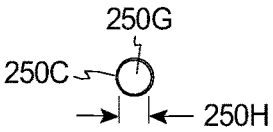
FIG. 2C is a top plan view of a supply orifice of the supply valve of FIGS. 2A and 2B.

It should be noted that supply valve 250 has a supply orifice 250G. FIG. 2C is a top view of the tubular shaped, inlet conduit 250C that better illustrates the supply orifice 250G. In this non-exclusive embodiment, the supply orifice 250G is a circular opening having a supply orifice area ("valve area") with a supply orifice diameter 250H. With this design, the size of the supply orifice area is one of the factors that influences the flow rates that are possible with the supply valve 250. Generally speaking, as the size of the supply orifice area is increased, possible flow rates into the chamber increase, but the accuracy of the control of the flow rate is decreased.

Figure 3A:
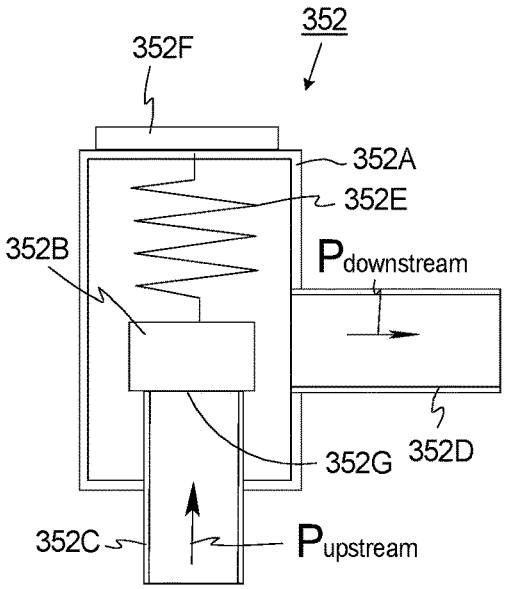
FIG. 3A is simplified cut-away view of one, non-exclusive example of an exhaust valve having features of the present invention in a closed position.
Figure 3B:
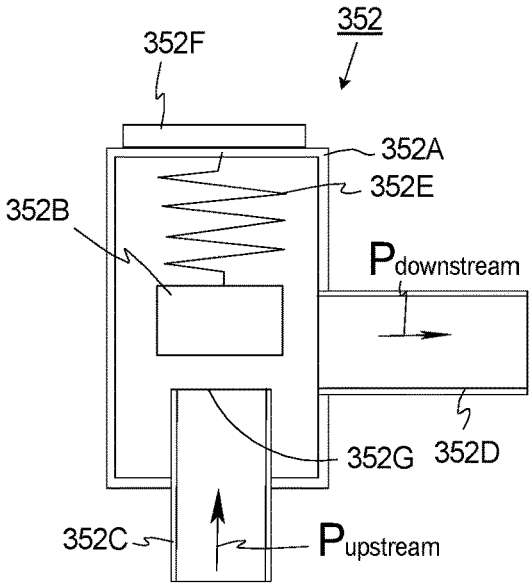
FIG. 3B is simplified cut-away view of the exhaust valve of FIG. 3A in an open position.

FIG. 3A is simplified cut-away view of one, non-exclusive example of an exhaust valve 352 in a closed position, and FIG. 3B is a simplified cut-away view of the exhaust valve 352 of FIG. 3A in an open position. The exhaust valve 352 can be used as the first exhaust valve 38D of the first valve sub-assembly 38A, and/or the second exhaust valve 38F of the second valve sub-assembly 38B of FIG. 1. In this embodiment, the exhaust valve 352 is a poppet type valve that includes a valve housing 352A, a movable valve body 352B, an inlet conduit 352C, an outlet conduit 352D, a resilient member 352E (e.g. a spring) that urges the valve body 352B against the inlet conduit 352C, and a solenoid 352F.

In this simplified example, the valve housing 352A is somewhat cylindrical shaped, the valve body 352B is disk shaped, and the conduits 352C, 352D are tubular shaped. Further, in FIG. 3A, the exhaust valve 352 is illustrated in the closed position when the control system (not shown in FIG. 3A) is not directing current to the solenoid 352F. As a result thereof, the resilient member 352E urges the valve body 352B against the top of the inlet conduit 352C to close the valve 352. It should be noted that when no current is directed to the solenoid 352F, the valve remains closed as long as the spring preload force is greater than the force generated by the pressure difference between the pressure upstream and the pressure downstream.

Alternatively, in FIG. 3B, the valve 352 is illustrated in the open position when the control system (not shown in FIG. 3B) is directing current to the solenoid 352F. In this embodiment, current directed to the solenoid generates a solenoid force that urges (attracts) the valve body 352B upward away from the top of the inlet conduit 352C. Typically, the magnitude of solenoid force is proportional to the current. When sufficient current is directed to the solenoid 352F, the spring preload force of the resilient member 352F is overcome, the valve body 352B is moved away from the top of the inlet conduit 352C, and the valve 352 is opened. Further, the amount of current will determine how far the valve 352 is opened. Generally, the size of the valve opening increases as current increases.

Figure 3C:
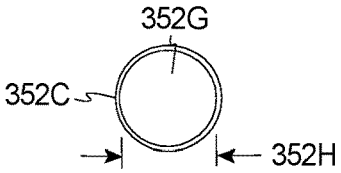
FIG. 3C is a top plan view of a supply orifice of the supply valve of FIGS. 3A and 3B.

It should be noted that exhaust valve 352 has an exhaust orifice 352G. FIG. 3C is a top view of the tubular shaped, inlet conduct 352C that better illustrates the exhaust orifice 352G. In this non-exclusive embodiment, the exhaust orifice 352G is a circular opening having an exhaust orifice area ("valve area") with an exhaust orifice diameter 352H. With this design, the size of the exhaust orifice area is one of the factors that influence the flow rates that are possible with the exhaust valve 352. Generally speaking, as the size of the exhaust orifice area is increased, possible flow rates from the chamber increase, but the accuracy of the control of the flow rate is decreased.

With reference to FIGS. 2C and 3C, in certain embodiments, for the first valve sub-assembly 38A (illustrated in FIG. 1) and/or for the second valve sub-assembly 38B (illustrated in FIG. 1), the exhaust orifice area of the exhaust orifice 352G is different from the supply orifice area of the supply orifice 250G. In alternative, non-exclusive embodiments, for the first valve sub-assembly 38A (illustrated in FIG. 1) and/or for the second valve sub-assembly 38B (illustrated in FIG. 1), the exhaust orifice area is at least 10, 20, 50, 75, 100, 150, 200, 250, 300, 350, 400, 500 percent or larger than the supply orifice area. Stated in another fashion, in alternative, non-exclusive embodiments, for the first valve sub-assembly 38A (illustrated in FIG. 1) and/or for the second valve sub-assembly 38B (illustrated in FIG. 1), the exhaust valve is at least 10, 20, 50, 75, 100, 150, 200, 250, 300, 350, 400, 500 percent or larger than the supply valve.

With this design, in certain embodiments, separate proportional valves 250, 352 are used for supplying fluid and exhausting fluid for each chamber 34A, 34B (illustrated in FIG. 1). Further, proportional valves 250, 352 with different orifice 250G, 352G sizes can be selected for supplying fluid and exhausting fluid to achieve the performance requirements of the system. As a result thereof, the valves 250, 352 can be individually sized to achieve the desired performance of the fluid actuator assembly 24.

Figure 4:
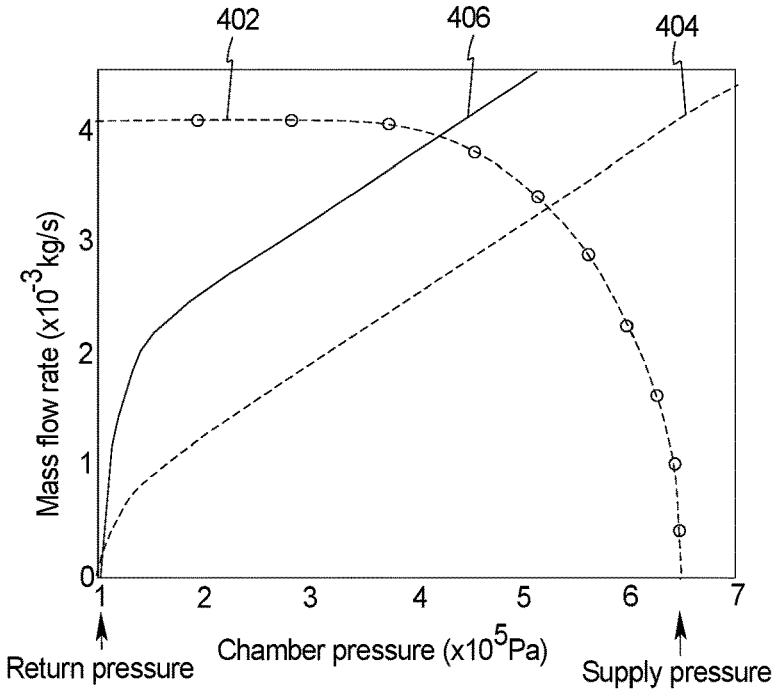
FIG. 4 is a graph that illustrates a mass flow rate versus chamber pressure thru a first sized orifice and a second sized orifice used in a fluid actuator assembly.

FIG. 4 is a graph that illustrates mass flow rate versus chamber pressure thru a first sized orifice for a valve (not shown) used in a fluid actuator assembly (not shown). In FIG. 4, curve 402 (dashed line with small circles) represents the mass flow rate versus chamber pressure when the fluid is being supplied to the piston chamber (not shown) via the first sized orifice; and curve 404 (dashed line) represents the mass flow rate versus pressure when the fluid is exhausted from the piston chamber (not shown) via the first sized orifice.

As illustrated in FIG. 4, comparing curves 402 and 404, if the same sized orifice area is used for the supply valve and the exhaust valve, the mass flow rate for filling up and exhaust will be different with respect to the chamber pressure. This is due to different upstream and downstream pressures in filling up or exhaust. Stated in another fashion, comparing curves 402 and 404, for a same sized orifice area, when the chamber pressure is in the middle of the supply pressure and return pressure, the mass flow rate for filling up is approximately seventy percent higher than that for exhaust. Thus, with the same orifice size for both the supply and exhaust, the mass flow rate for exhaust is usually smaller than filling up during most preferable operating chamber pressure range. As a result thereof, higher pressure will be required for the driving chamber to exhaust the fluid from the opposite chamber to compensate for the limitation. This can limit the maximum actuator velocity.

Alternatively, if both the supply valve and the exhaust valve have the same, larger valve size, the control resolution of the supply valve will be less and the control accuracy of the valve assembly will be diminished.

As provided above, in certain embodiments, the orifice size of the exhaust valve 352 (illustrated in FIG. 3) is designed to be greater than the orifice size of the supply valve 250 (illustrated in FIG. 2). Curve 406 (solid line) represents the mass flow rate versus pressure when the fluid is exhausted from the piston chamber (not shown) via the second sized orifice which is larger than the first sized orifice. As a result of the larger second sized orifice, the mass flow rate for exhaust is greater and the exhaust of the chamber is faster. This will allow for greater maximum actuator velocity.

Figure 5:
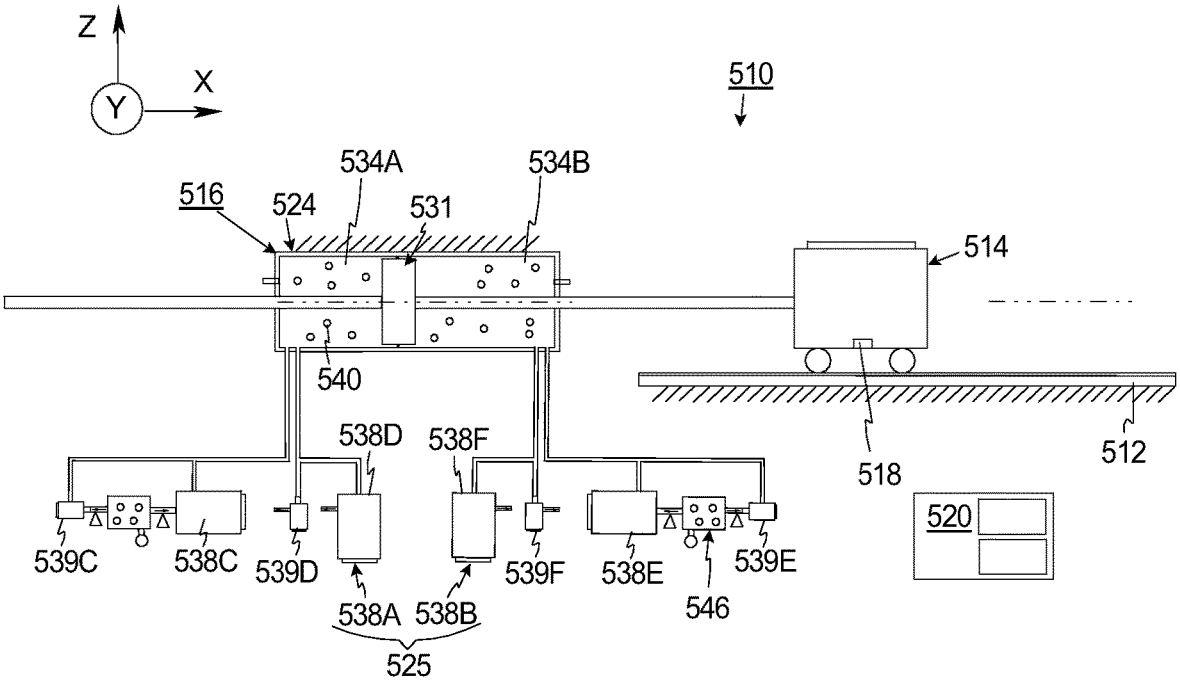
FIG. 5 is a simplified side illustration of another embodiment of a stage assembly having features of the present invention.

FIG. 5 is a simplified illustration of another embodiment of a stage assembly 510 that includes a base 512, a stage 514, a measurement system 518, and a control system 520 (illustrated as a box) that are somewhat similar to the corresponding components described above and illustrated in FIG. 1. However, in the embodiment illustrated in FIG. 5, the fluid actuator assembly 524 of the stage mover assembly 516 is slightly different. More specifically, in FIG. 5, the fluid actuator assembly 524 includes (i) the piston assembly 531 that is similar to the corresponding component described above; and (ii) the valve assembly 525 that is different.

In FIG. 5, the valve assembly 525 is again controlled by the control system 520 to accurately and individually control the pressure in each chamber 534A, 534B. Further, the valve assembly 525 includes (i) a first (chamber one) valve sub-assembly 538A that is controlled to control the flow of the working fluid 540 into and out of the first chamber 534A; and (ii) a second (chamber two) valve sub-assembly 538B that is controlled to control the flow of the working fluid 540 into and out of the second chamber 5348.

In this embodiment, the first valve sub-assembly 538A includes (i) a coarse supply valve 538C that is controlled to control the flow of the working fluid 40 into the first chamber 534A; (ii) a fine supply valve 539C that is controlled to control the flow of the working fluid 540 into the first chamber 534A; (iii) a coarse exhaust valve 538D that is controlled to control the flow of the working fluid 540 out of the first chamber 534A; and (iv) a fine exhaust valve 539D that is controlled to control the flow of the working fluid 540 out of the first chamber 534A. Similarly, the second valve sub-assembly 538B includes (i) a coarse supply valve 538E that is controlled to control the flow of the working fluid 40 into the second chamber 534B; (ii) a fine supply valve 539E that is controlled to control the flow of the working fluid 540 into the second chamber 534B; (iii) a coarse exhaust valve 538F that is controlled to control the flow of the working fluid 540 out of the second chamber 534B; and (iv) a fine exhaust valve 539F that is controlled to control the flow of the working fluid 540 out of the second chamber 534. It should be noted that any of these valves can alternatively be referred to as a first, second, third, or fourth valve.

Additionally, in this embodiment, the fluid actuator assembly 524 can include one or more fluid pressure sources 546 (two are shown) that provide pressurized working fluid 540 to the supply valves 538C, 539C, 538E, 539E. The fluid pressure sources 546 can be similar to the corresponding components described above and illustrated in FIG. 1.

As provided in more detail below, the valves 538C, 539C, 538D, 539D, 538E, 539E, 538F, 539F are designed to improve the speed and accuracy of the fluid actuator assembly 24. The type of valve 538C, 539C, 538D, 539D, 538E, 539E, 538F, 539F utilized can be varied. As non-exclusive examples, each valve 538C, 539C, 538D, 539D, 538E, 539E, 538F, 539F can be a two-way proportional valve such as a poppet ("mushroom") type valve or a spool-type valve.

In one embodiment, for the first valve sub-assembly 538A, (i) the coarse supply valve 538C is larger than the fine supply valve 539C; and (ii) the coarse exhaust valve 538D is larger than the fine exhaust valve 539D. Similarly, for the second valve sub-assembly 538B, (i) the coarse supply valve 538E is larger than the fine supply valve 539E; and (ii) the coarse exhaust valve 538F is larger than the fine exhaust valve 539F. As provided herein, a small orifice proportional valve has limited fluid flow and can't meet the requirements for fast response of the large volume pressure control. If large orifice proportional valve is being used for large flow, then the precision pressure control would not be compromised. The present invention allows high fluid flow control with large orifice (coarse) proportional valve and pressure control with small orifice (fine) proportional valve.

The accuracy of the pressure control inside each chamber 534A, 534B is affected by the accuracy of the flow control thru each valve 538C, 539C, 538D, 539D, 538E, 539E, 538F, 539F. One big size valve will introduce large error as the system scale increases. This invention utilizes large proportional valve for coarse flow control and small proportional valve for fine pressure control.

The control system 520 controls the valve assembly 525 and each individual valve 538C, 539C, 538D, 539D, 538E, 539E, 538F, 539F to control the flow of the working fluid 540 into and out of each chamber 534A, 534B. By selectively controlling the flow of the working fluid 540 into and out of each chamber 534A, 534B, the valve assembly 525 can be controlled to generate the controllable force that accurately moves the stage 514.

Figure 6A:
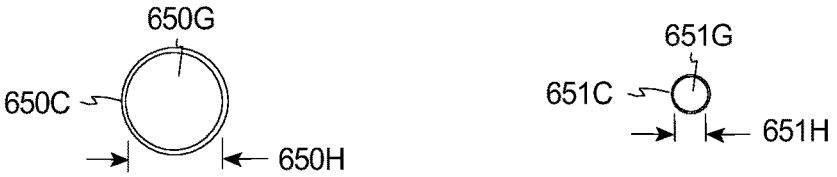
FIG. 6A illustrates a portion of a coarse supply valve and a fine supply valve having features of the present invention.

FIG. 6A is a top view of an inlet conduct 650C for the coarse supply valve and a top view of an inlet conduit 651C for the fine supply valve for one of the valve sub-assemblies (illustrated in FIG. 5). In this non-exclusive embodiment, (i) the coarse supply orifice 650G for the coarse supply valve is a circular opening having a coarse supply orifice area and a coarse supply orifice diameter 650H; and (ii) the fine supply orifice 651G for the fine supply valve is a circular opening having a fine supply orifice area and a fine supply orifice diameter 651H.

As illustrated in FIG. 6A, for the first valve sub-assembly 538A (illustrated in FIG. 5) and/or for the second valve sub-assembly 538B (illustrated in FIG. 5), the coarse supply orifice area of the coarse supply orifice 650G is larger than the fine supply orifice area of the fine supply orifice 651G. In alternative, non-exclusive embodiments, for the first valve sub-assembly 538A and/or for the second valve sub-assembly 538B, the coarse supply orifice area is at least 10, 20, 50, 75, 100, 150, 200, 250, 300, 350, 400, 500 percent larger than the fine supply orifice area. This concept is useful for large volume flow control with precision pressure control, because large orifice proportional valve for large flow control and small orifice proportional valve for fine pressure control.

Figure 6B:
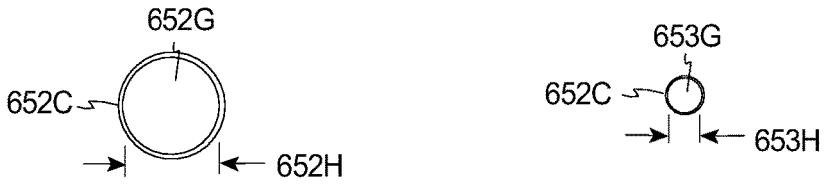
FIG. 6B illustrates a portion of a coarse exhaust valve and a fine exhaust valve having features of the present invention.

Somewhat similarly, FIG. 6B is a top view of an inlet conduct 652C for the coarse exhaust valve and a top view of an inlet conduit 653C for the fine exhaust valve for one of the valve sub-assemblies (illustrated in FIG. 5). In this non-exclusive embodiment, (i) the coarse exhaust orifice 652G for the coarse exhaust valve is a circular opening having a coarse exhaust orifice area and a coarse exhaust orifice diameter 652H; and (ii) the fine exhaust orifice 653G for the fine exhaust valve is a circular opening having a fine exhaust supply orifice area and a fine exhaust orifice diameter 651H.

As illustrated in FIG. 6B, for the first valve sub-assembly 538A (illustrated in FIG. 5) and/or for the second valve sub-assembly 538B (illustrated in FIG. 5), the coarse exhaust orifice area of the coarse exhaust orifice 650G is larger than the fine exhaust orifice area of the fine exhaust orifice 651G. In alternative, non-exclusive embodiments, for the first valve sub-assembly 538A and/or for the second valve sub-assembly 538B, the coarse exhaust orifice area is at least 10, 20, 50, 75, 100, 150, 200, 250, 300, 350, 400, 500 percent larger than the fine exhaust orifice area. This concept is useful for large volume flow control with precision pressure control, because large orifice proportional valve for large flow control and small orifice proportional valve for fine pressure control.

Figure 7:
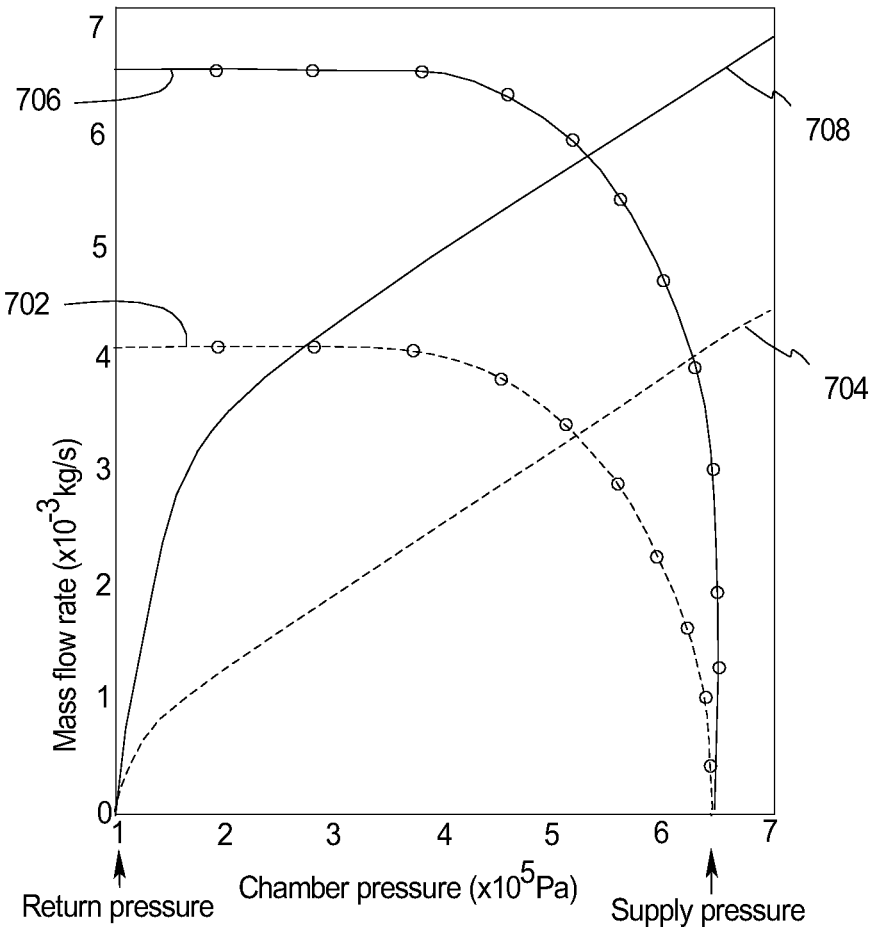
FIG. 7 is a graph that illustrates mass flow rate versus chamber pressure thru a first sized orifice for a valve (not shown) used in a fluid actuator assembly (not shown).

FIG. 7 is a graph that illustrates mass flow rate versus chamber pressure thru a first ("fine") sized orifice (not shown in FIG. 7) for a fine valve (not shown in FIG. 7), and thru a second ("coarse") sized orifice (not shown in FIG. 7) for a coarse valve (not shown in FIG. 7). In this example, the first sized orifice has a smaller orifice area than the second sized orifice. In FIG. 7, curve 702 (dashed line with small circles) represents the mass flow rate versus chamber pressure when the fluid is being supplied to the piston chamber (not shown) via the first, fine sized orifice; and curve 704 (dashed line) represents the mass flow rate versus pressure when the fluid is exhausted from the piston chamber (not shown) via the first, fine sized orifice. Similarly, curve 706 (solid line with small circles) represents the mass flow rate versus chamber pressure when the fluid is being supplied to the piston chamber (not shown) via the coarse sized orifice; and curve 708 (solid line) represents the mass flow rate versus pressure when the fluid is exhausted from the piston chamber (not shown) via the coarse sized orifice.

As illustrated in FIG. 7, comparing curves 702 and 706, the mass flow rate is different for the different sized supply orifices; and comparing curves 704 and 708, the mass flow rate is different for the different sized exhaust orifices. With this design, coarse control of the fluid directed in the chamber can be achieved using the coarse supply valve, and fine control of the fluid directed in the chamber can be achieved using the fine supply valve. Stated in another fashion, the coarse supply valve can be used to rapidly add fluid to the chamber for improved actuation speed, while the fine supply valve can accurately add fluid to the chamber for improved accuracy.

Similarly, coarse control of the fluid exhausted from the chamber can be achieved using the coarse exhaust valve, and fine control of the fluid exhausted from the chamber can be achieved using the fine exhaust valve. Stated in another fashion, the coarse exhaust valve can be used to rapidly exhaust fluid from the chamber for improved actuation speed, while the fine exhaust valve can accurately exhaust fluid from the chamber for improved accuracy.

Figure 8A:
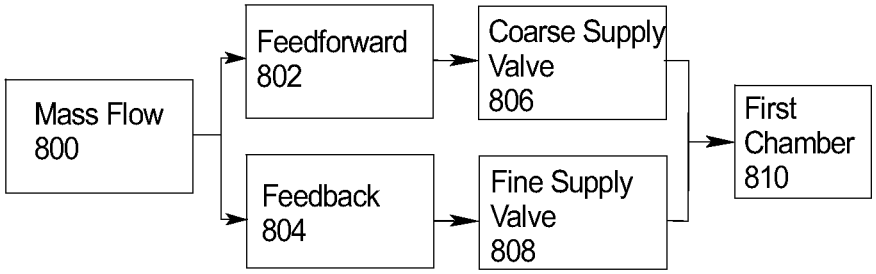
FIG. 8A is a control block diagram that illustrates a first, non-exclusive method for controlling the valves.

FIG. 8A is a control block diagram that illustrates one, non-exclusive example of the method used by the control system for controlling the fluid actuator assembly 524 of FIG. 5 to accurately position the stage 514 (illustrated in FIG. 5). More specifically, the control block diagram illustrates one, non-exclusive method for controlling the supply valves for the first valve sub-assembly 538A (illustrated in FIG. 5) to precisely position the stage 514. It should be noted that the exhaust valves of the first valve sub-assembly 538A and the valves of the second valve sub-assembly 538B can be controlled in a similar fashion.

In the control block diagram, at block 800, the control system determines the mass flow of the working fluid that is to be directed into the first chamber. Next, at block 802, the feedforward response is sent to the coarse supply valve 806, and at block 804, the feedback response (generated using feedback from the pressure sensor for the first chamber) is sent to the fine supply valve 808. The valves 806, 808 direct the working fluid into the first chamber 810. With this design, the coarse supply valve 806 is used for the feedforward response, and the fine supply valve 808 is used to make the feedback response.

Figure 8B:
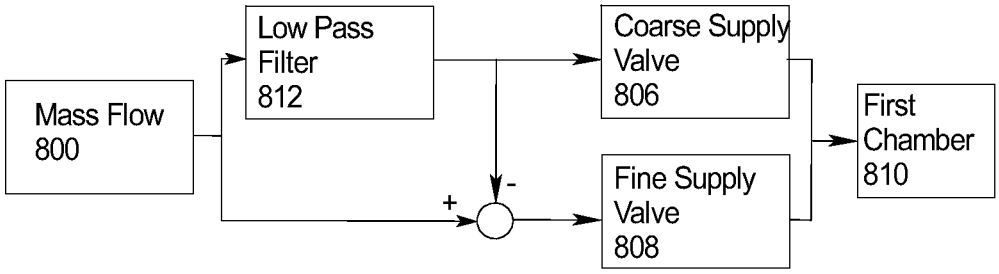
FIG. 8B is a control block diagram that illustrates a second, non-exclusive method for controlling the valves.

FIG. 8B is a control block diagram that illustrates another, non-exclusive example of the method for controlling the fluid actuator assembly 524 of FIG. 5 to accurately position the stage 514 (illustrated in FIG. 5). More specifically, the control block diagram illustrates another, non-exclusive method for controlling the supply valves for the first valve sub-assembly 538A (illustrated in FIG. 5) to precisely position the stage 514. It should be noted that the exhaust valves of the first valve sub-assembly 538A and the valves of the second valve sub-assembly 538B can be controlled in a similar fashion.

In the control block diagram of FIG. 8B, at block 800, the control system determines the mass flow of the working fluid that is to be directed into the first chamber. Next, at block 802, the control signal is sent to a low pass filter 812 and the coarse supply valve 806. The low pass filter signal is subtracted from control signal essentially generating high frequency control input that is sent to the fine supply valve 808. The valves 806, 808 direct the working fluid into the first chamber 810. With this design, the coarse supply valve 806 is used to make the low frequency control input, and the fine supply valve 808 is used to make the high frequency control input.

In yet another embodiment, the control system can control the coarse supply valve to make large changes (high mass flow range) in the mass flow of the working fluid and the fine supply valve to make fine changes (low mass flow range) in the mass flow of the working fluid.

Figure 9A:
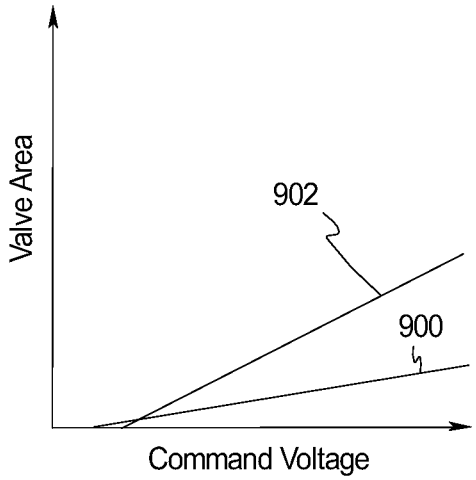
FIG. 9A is a graph that illustrates valve area versus valve voltage for a fine and coarse valve.
Figure 9B:
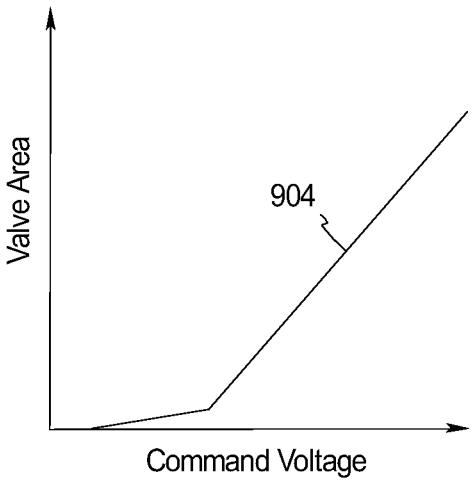
FIG. 9B is a graph that illustrates total valve area versus valve voltage for a fine and coarse valve controlled in a certain fashion.

FIG. 9A is a graph that illustrates valve area versus valve voltage for a coarse valve and a fine valve. More specifically, (i) line 900 represents the fine valve area versus valve voltage; and (iii) line 902 represents the coarse valve area versus valve voltage. FIG. 9B is a graph that includes line 904 that illustrates total valve area versus valve voltage for the coarse valve and the fine valve controlled in a certain fashion. In this embodiment, the two valves can be used in combination in a way such that controller command vs total open area of the combined valves becomes as shown in FIG. 9B. In this example, when the controller command is small, only the fine valve is used. In contrast, when the controller command is large, both the fine and coarse valves can be used and the effective total open area is relatively large.

Figure 10A:
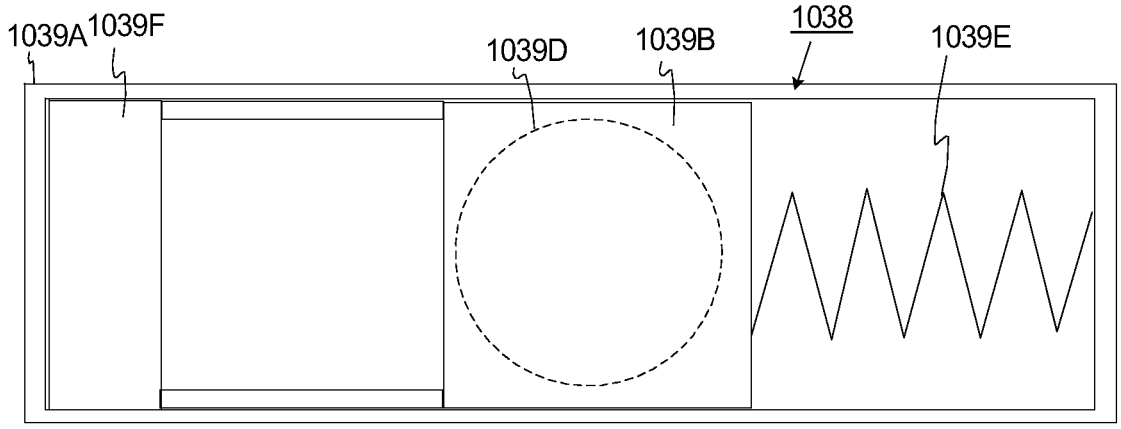
FIG. 10A is simplified cut-away view of another valve in a closed position.
Figure 10B:
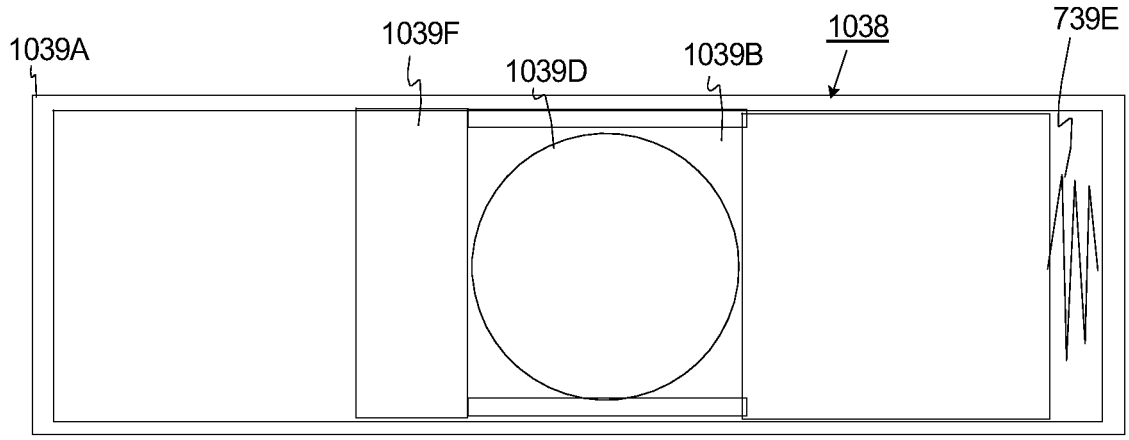
FIG. 10B is simplified cut-away view of the valve of FIG. 10A in an open position.

FIGS. 10A and 10B are simplified cut-away illustrations of another type of valve 1038 at various valve positions that can be used as one of the valves 38C, 38D, 38E, 38F from FIG. 1 and/or one of the valves 538C, 539C, 538D, 539D, 538E, 539E, 538F, 539F of FIG. 5. In this embodiment, the valve 1038 is a spool type valve that includes a valve housing 1039A, a movable valve body 1039B (sometimes referred to as a "spool"), an inlet opening (not shown), an outlet opening 1039D, a resilient member 1039E (e.g. a spring) that urges the valve body 1039B from right to left, and a solenoid 1039F that moves the valve body 1039B from the left to the right.

In this simplified example, the valve housing 1038A is somewhat hollow cylindrical shaped, the valve body 1039B is disk shaped, and the openings 1039D are circular shaped and are positioned on opposite sides of the valve housing 1038A with the valve body 1039B positioned there between. Further, in FIG. 10A, the valve 1038 is illustrated in the fully closed position when the control system (not shown in FIG. 10A) is not directing current to the solenoid 1039F. At this time, the valve body 1039B covers both the inlet and the outlet 1039D to close the valve 1038.

Alternatively, in FIG. 10B, the valve 1038 is illustrated in the fully open position when the control system (not shown in FIG. 10A) is directing current to the solenoid 1039F. At this time, the valve body 1039B is moved out of the way of both the inlet and the outlet 1039D to open the valve 1038.

In this embodiment, the inlet and outlet 1039D define the valve orifice having an orifice area. Further, the valve orifice can be designed to achieve the desire performance.

Figure 11:
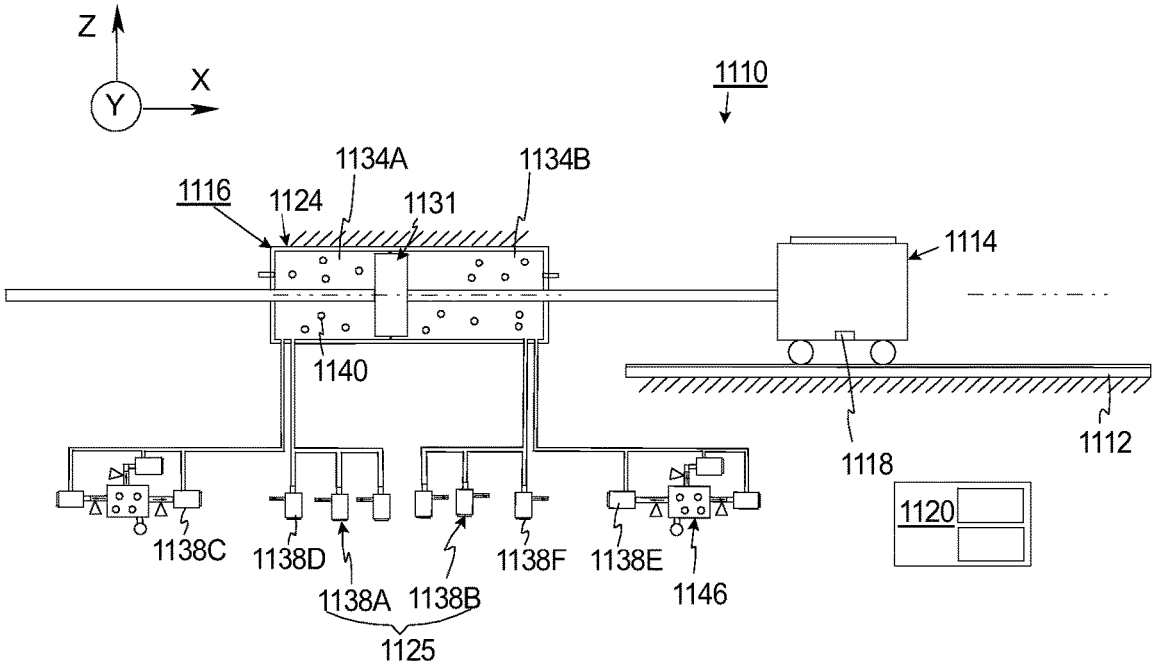
FIG. 11 is a simplified side illustration of yet another embodiment of a stage assembly having features of the present invention.

FIG. 11 is a simplified illustration of another embodiment of a stage assembly 1110 that includes a base 1112, a stage 1114, a measurement system 1118, and a control system 1120 (illustrated as a box) that are somewhat similar to the corresponding components described above and illustrated in FIG. 5. However, in the embodiment illustrated in FIG. 11, the fluid actuator assembly 1124 of the stage mover assembly 1116 is slightly different. More specifically, in FIG. 11, the fluid actuator assembly 1124 includes (i) the piston assembly 1131 that is similar to the corresponding component described above; and (ii) the valve assembly 1125 that is different.

In FIG. 11, the valve assembly 1125 is again controlled by the control system 1120 to accurately and individually control the pressure in each chamber 1134A, 1134B. Further, the valve assembly 1125 includes (i) a first (chamber one) valve sub-assembly 1138A that is controlled to control the flow of the working fluid 1140 into and out of the first chamber 1134A; and (ii) a second (chamber two) valve sub-assembly 1138B that is controlled to control the flow of the working fluid 1140 into and out of the second chamber 11348.

In this embodiment, the first valve sub-assembly 1138A includes (i) a plurality of first supply valve 1138C (first supply valve set) that are individually controlled to control the flow of the working fluid 1140 into the first chamber 1134A; and (ii) a plurality of first exhaust valves 538D (first exhaust valve set) that are individually controlled to control the flow of the working fluid 1140 out of the first chamber 1134A. Similarly, the second valve sub-assembly 1138B includes (i) a plurality of second supply valves 1138E (second supply valve set) that are individually controlled to control the flow of the working fluid 1140 into the second chamber 1134B; and (ii) a plurality of second exhaust valve 1138F (second exhaust valve set) that are individually controlled to control the flow of the working fluid 1140 out of the second chamber 1134B. The number of first supply valves 1138C, first exhaust valves 1138D, second supply valves 1138D, and second exhaust valves 1138F can vary. In the non-exclusive embodiment illustrated in FIG. 11, (i) the first valve sub-assembly 1138A includes three, first supply valves 1138C, and three, first exhaust valves 1138D; and (ii) the second valve sub-assembly 11388 includes three, second supply valves 1138E, and three, second exhaust valves 1138F. In this embodiment, each set includes three valves. Alternatively, the number for each can set of valves can include two or more than three valves.

It should be noted that any of the valves can alternatively be referred to as a first, second, third, or fourth valve.

Additionally, in this embodiment, the fluid actuator assembly 1124 can include one or more fluid pressure sources 1146 (two are shown) that provide pressurized working fluid 540 to the supply valves 1138C, 1138E. The fluid pressure sources 1146 can be similar to the corresponding components described above and illustrated in FIG. 1.

As provided in more detail below, the valves 1138C, 1138D, 1138E, 1138F are designed to improve the speed and accuracy of the fluid actuator assembly 1124. As non-exclusive examples, each valve 1138C, 1138D, 1138E, 1138F can be a two-way proportional valve such as a poppet ("mushroom") type valve or a spool-type valve.

In one embodiment, for the first valve sub-assembly 1138A, (i) each of the first supply valves 1138C are approximately the same size (e.g. same orifice size); and (ii) each of the first exhaust valves 1138D are approximately the same size (e.g. same orifice size). Similarly, for the second valve sub-assembly 1138B, (i) each of the second supply valves 1138E are approximately the same size (e.g. same orifice size); and (ii) each of the second exhaust valves 1138F are approximately the same size (e.g. same orifice size). In this embodiment, similar valves can be used for each set of valves. Alternatively, for the first valve sub-assembly 1138A, (i) one or more of the first supply valves 1138C can have a different sized orifice; and (ii) one or more of the first exhaust valves 1138D can have a different sized orifice. Similarly, for the second valve sub-assembly 1138B, (i) one or more of the second supply valves 1138E can have a different sized orifice; and (ii) one or more of the second exhaust valves 1138F can have a different sized orifice.

As provided herein, a small orifice proportional valve has limited fluid flow and can't meet the requirements for fast response of the large volume pressure control. The present invention allows high fluid flow control by a valve set by using multiple valves in parallel when large flow is required and using a single valve of the valve set when fine control is required.

The control system 1120 controls the valve assembly 1125 to control the flow of the working fluid 1140 into and out of each chamber 1134A, 1134B. By selectively controlling the flow of the working fluid 1140 into and out of each chamber 1134A, 1134B, the valve assembly 1125 can be controlled to generate the controllable force that accurately moves the stage 1114.

Figure 12A:
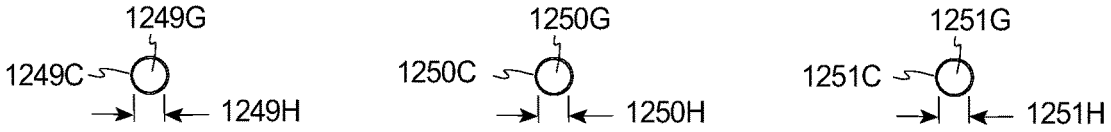
FIG. 12A illustrates a portion of three supply valve having features of the present invention.

FIG. 12A is a top view of an inlet conduct for three supply valves 1249C, 1250C, 1251C of a supply valve set. In this non-exclusive embodiment, each supply valve 1249C, 1250C, 1251C has a respective supply orifice 1249G, 1250G, 1251G having a corresponding supply orifice area and a supply orifice diameter 1249H, 1250H, 1251H. In this embodiment, each valve of the supply valve set has the same supply orifice area. Alternatively, one of the valves in the supply valve set can be designed to have a different supply orifice area to suit the design requirements.

Figure 12B:
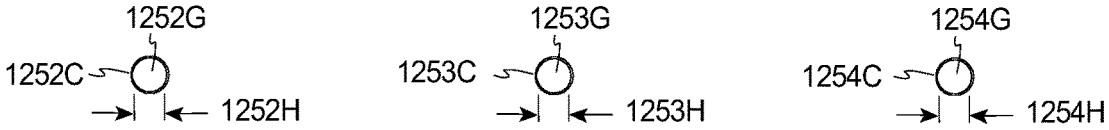
FIG. 12B illustrates a portion of three exhaust valves having features of the present invention.

Somewhat similarly, FIG. 12B is a top view of an inlet conduct for three exhaust valves 1252C, 1253C, 1254C of a supply valve set. In this non-exclusive embodiment, each exhaust valve 1252C, 1253C, 1254C has a respective exhaust orifice 1252G, 1253G, 1254G having a corresponding exhaust orifice area and an exhaust orifice diameter 1252H, 1253H, 1254H. In this embodiment, each valve of the exhaust valve set has the same exhaust orifice area. Alternatively, one of the valves in the exhaust valve set can be designed to have a different exhaust orifice area to suit the design requirements.

Comparing FIGS. 12A and 12B, in one non-exclusive example, the orifice area of each supply valve 1249C, 1250C, 1251C is approximately equal to the orifice area of each exhaust valves 1252C, 1253C, 1254C. Alternatively, for example, the orifice area of one or more of the supply valves 1249C, 1250C, 1251C can be less than orifice area of one or more of the exhaust valves 1252C, 1253C, 1254C.

Figure 13:
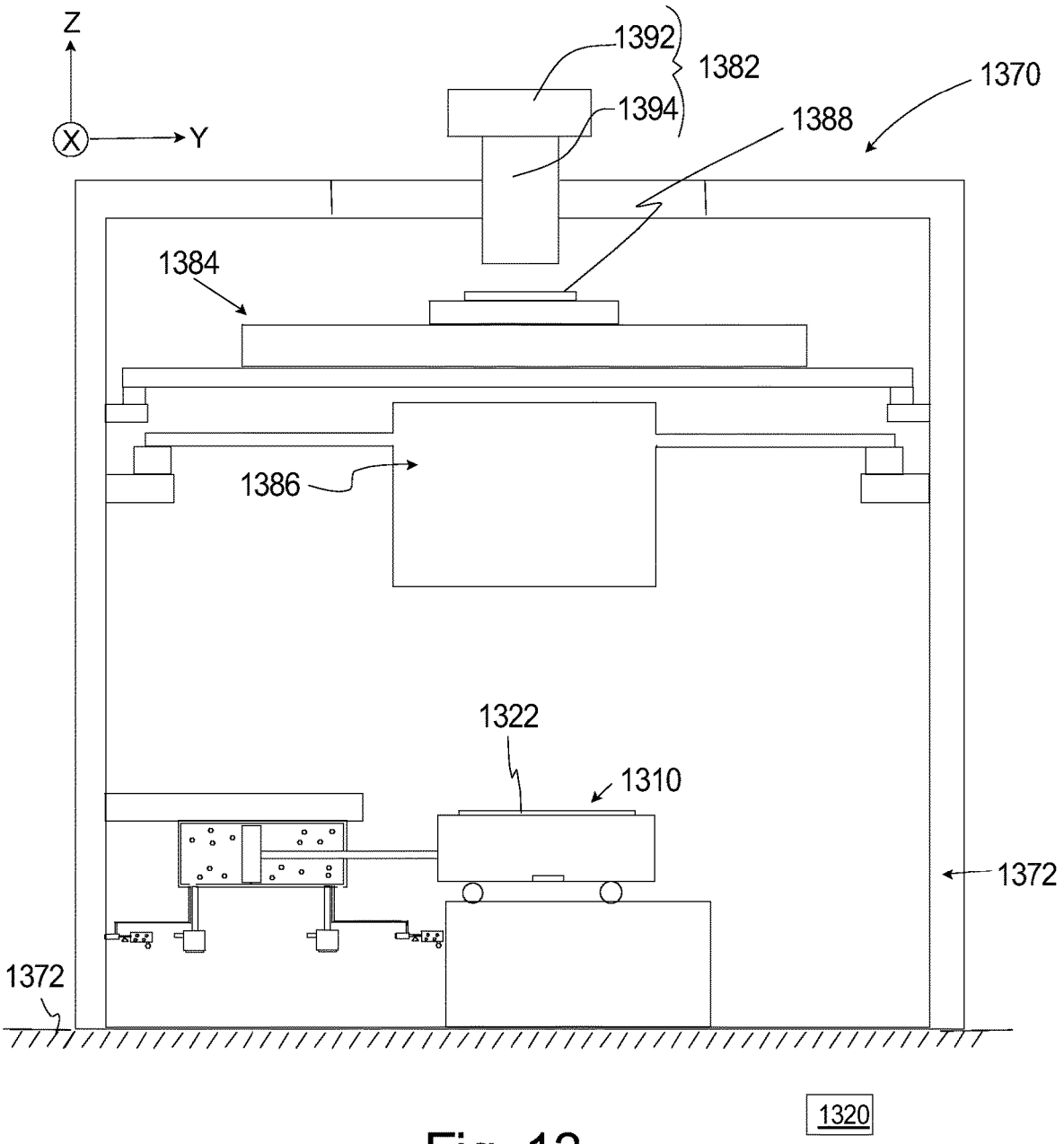
FIG. 13 is a schematic illustration of an exposure apparatus having features of the present invention.

FIG. 13 is a schematic view illustrating an exposure apparatus 1370 useful with the present invention. The exposure apparatus 1370 includes the apparatus frame 1372, an illumination system 1382 (irradiation apparatus), a mask stage assembly 1384, an optical assembly 1386 (lens assembly), a plate stage assembly 1310, and a control system 1320 that controls the mask stage assembly 1384 and the plate stage assembly 1310.

The exposure apparatus 1370 is particularly useful as a lithographic device that transfers a pattern (not shown) of liquid crystal display device from the mask 1188 onto the workpiece 1322.

The apparatus frame 1372 is rigid and supports the components of the exposure apparatus 1370. The design of the apparatus frame 1372 can be varied to suit the design requirements for the rest of the exposure apparatus 1370.

The illumination system 1382 includes an illumination source 1392 and an illumination optical assembly 1394. The illumination source 1392 emits a beam (irradiation) of light energy. The illumination optical assembly 1394 guides the beam of light energy from the illumination source 1392 to the mask 1388. The beam illuminates selectively different portions of the mask 1388 and exposes the workpiece 1322.

The optical assembly 1386 projects and/or focuses the light passing through the mask 1388 to the workpiece 1322. Depending upon the design of the exposure apparatus 1370, the optical assembly 1386 can magnify or reduce the image illuminated on the mask 1388.

The mask stage assembly 1384 holds and positions the mask 1388 relative to the optical assembly 1386 and the workpiece 1322. Similarly, the plate stage assembly 1310 holds and positions the workpiece 1322 with respect to the projected image of the illuminated portions of the mask 1388.

There are a number of different types of lithographic devices. For example, the exposure apparatus 1370 can be used as scanning type photolithography system that exposes the pattern from the mask 1388 onto the glass workpiece 1322 with the mask 1388 and the workpiece 1322 moving synchronously. Alternatively, the exposure apparatus 1370 can be a step-and-repeat type photolithography system that exposes the mask 1388 while the mask 1388 and the workpiece 1322 are stationary.

However, the use of the exposure apparatus 1370 and the stage assemblies provided herein are not limited to a photolithography system for liquid crystal display device manufacturing. The exposure apparatus 1370, for example, can be used as a semiconductor photolithography system that exposes an integrated circuit pattern onto a wafer or a photolithography system for manufacturing a thin film magnetic head. Further, the present invention can also be applied to a proximity photolithography system that exposes a mask pattern by closely locating a mask and a substrate without the use of a lens assembly. Additionally, the present invention provided herein can be used in other devices, including other flat panel display processing equipment, elevators, machine tools, metal cutting machines, inspection machines and disk drives.

A photolithography system according to the above described embodiments can be built by assembling various subsystems, including each element listed in the appended claims, in such a manner that prescribed mechanical accuracy, electrical accuracy, and optical accuracy are maintained. In order to maintain the various accuracies, prior to and following assembly, every optical system is adjusted to achieve its optical accuracy. Similarly, every mechanical system and every electrical system are adjusted to achieve their respective mechanical and electrical accuracies. The process of assembling each subsystem into a photolithography system includes mechanical interfaces, electrical circuit wiring connections and air pressure plumbing connections between each subsystem. Needless to say, there is also a process where each subsystem is assembled prior to assembling a photolithography system from the various subsystems. Once a photolithography system is assembled using the various subsystems, a total adjustment is performed to make sure that accuracy is maintained in the complete photolithography system. Additionally, it is desirable to manufacture an exposure system in a clean room where the temperature and cleanliness are controlled.

Figure 14:
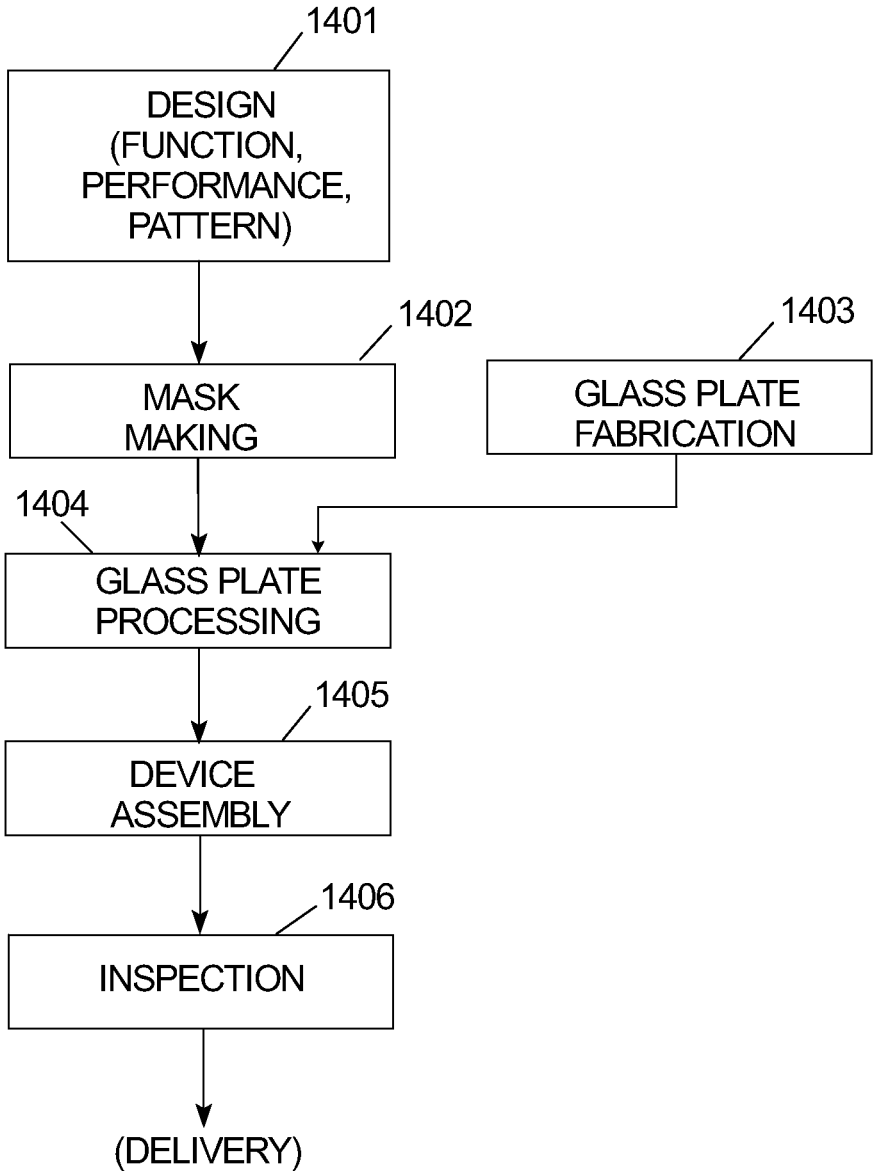
FIG. 14 is a flow chart that outlines a process for manufacturing a device in accordance with the present invention.

Further, a device can be fabricated using the above described systems, by the process shown generally in FIG. 14. In step 1401, the device's function and performance characteristics are designed. Next, in step 1402, a mask (reticle) having a pattern is designed according to the previous designing step, and in a parallel step 1403 a glass plate is made. The mask pattern designed in step 1402 is exposed onto the glass plate from step 1403 in step 1404 by a photolithography system described hereinabove in accordance with the present invention. In step 1405 the flat panel display device is assembled (including the dicing process, bonding process and packaging process), finally, the device is then inspected in step 1406.

While the particular assembly as shown and disclosed herein is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A stage assembly for positioning a workpiece along a movement axis, the stage assembly comprising:

a stage that is adapted to couple to the workpiece;

a base;

a fluid actuator assembly that is coupled to and moves the stage along the movement axis relative to the base, the fluid actuator assembly including (i) a piston housing that defines a piston chamber; (ii) a piston that is positioned within and moves relative to the piston chamber along a piston axis, the piston separating the piston chamber into a first chamber and a second chamber that are on opposite sides of the piston; and (iii) a first valve sub-assembly that includes a first supply valve that controls the flow of the working fluid into the first chamber, and a first exhaust valve that controls the flow of the working fluid out of the first chamber;

wherein the first supply valve has a first supply orifice having a first supply orifice area, and the first exhaust valve has a first exhaust orifice having a first exhaust orifice area; wherein the first supply orifice area is different from the first exhaust orifice area;

a control system that controls the fluid actuator assembly to control the flow of the working fluid into and out of the first chamber; and a second valve sub-assembly that controls the flow of the working fluid into and out of the second chamber; wherein the second valve sub-assembly includes a first supply valve that controls the flow of the working fluid into the second chamber, and a first exhaust valve that controls the flow of the working fluid out of the second chamber; wherein the first supply valve of the second valve sub-assembly has a first supply orifice having a first supply orifice area, and the first exhaust valve of the second valve sub-assembly has a first exhaust orifice having a first exhaust orifice area; wherein, for the second valve sub-assembly, the first exhaust orifice area is larger than the first supply orifice area.

2. The stage assembly of claim 1 wherein, for the first valve sub-assembly, the first exhaust orifice area is larger than the first supply orifice area.

3. The stage assembly of claim 1 wherein, for the first valve sub-assembly, the first exhaust orifice area is at least one hundred percent larger than the first supply orifice area.

4. The stage assembly of claim 1 wherein, for the second valve sub-assembly, the first exhaust orifice area is at least one hundred percent larger than the first supply orifice area.

5. The stage assembly of claim 4 wherein, for each valve sub-assembly, the first exhaust orifice area is at least ten percent larger than the first supply orifice area.

6. The stage assembly of claim 1 wherein the first valve sub-assembly includes a second supply valve that controls the flow of the working fluid into the first chamber; wherein the second supply valve has a second supply orifice having a second supply orifice area; and the second supply orifice area is larger than the first supply orifice area.

7. The stage assembly of claim 6 wherein the first valve sub-assembly includes a second exhaust valve that controls the flow of the working fluid out of the first chamber; wherein the second exhaust valve has a second exhaust orifice having a second exhaust orifice area; and the first exhaust orifice area is larger than the second exhaust orifice area.

8. The stage assembly of claim 1 wherein each valve is a proportional valve.

9. An exposure apparatus including an illumination source that generates an illumination beam, and the stage assembly of claim 1 that moves the stage relative to the illumination beam.

10. A method for positioning a workpiece along a movement axis, the method comprising:

providing a base;

coupling the workpiece to a stage;

moving the stage along the movement axis relative to the base with a fluid actuator assembly that includes (i) a piston housing that defines a piston chamber; (ii) a piston that is positioned within and moves relative to the piston chamber along a piston axis, the piston separating the piston chamber into a first chamber and a second chamber that are on opposite sides of the piston; and (iii) a first valve sub-assembly that controls the flow of a working fluid into the first chamber, the first valve sub-assembly including a first supply valve that controls the flow of the working fluid into the first chamber, and a first exhaust valve that controls the flow of the working fluid out of the first chamber; wherein the first supply valve has a first supply orifice having a first supply orifice area, and the first exhaust valve has a first exhaust orifice having a first exhaust orifice area; wherein the first supply orifice area is different from the first exhaust orifice area; and controlling the fluid actuator assembly with a control system to control the flow of the working fluid into and out of the first chamber, wherein the step of moving includes providing a second valve sub-assembly that controls the flow of the working fluid into and out of the second chamber; wherein the second valve sub-assembly includes a first supply valve that controls the flow of the working fluid into the second chamber, and a first exhaust valve that controls the flow of the working fluid out of the second chamber; wherein the first supply valve has a first supply orifice having a first supply orifice area, and the first exhaust valve has a first exhaust orifice having a first exhaust orifice area; wherein, for the second valve sub-assembly, the first exhaust orifice area is larger than the first supply orifice area.

11. The method of claim 10 wherein the step of moving includes, for the first valve sub-assembly, the first exhaust orifice area being larger than the first supply orifice area.

12. The method of claim 10 wherein the step of moving includes, for the first valve sub-assembly, the first exhaust orifice area being at least ten percent larger than the first supply orifice area.

13. The method of claim 10 wherein the step of providing includes, for the second valve sub-assembly, the first exhaust orifice area being at least one hundred percent larger than the first supply orifice area.

14. The method of claim 13 wherein the step of providing includes, for each valve sub-assembly, the first exhaust orifice area being at least one hundred percent larger than the first supply orifice area.

15. The method of claim 10 wherein the step of moving includes the first valve sub-assembly having a second supply valve that controls the flow of the working fluid into the first chamber; wherein the second supply valve has a second supply orifice having a second supply orifice area; and the second supply orifice area is larger than the first supply orifice area.

16. The method of claim 15 wherein the step of moving includes the first valve sub-assembly having a second exhaust valve that controls the flow of the working fluid out of the first chamber; wherein the second exhaust valve has a second exhaust orifice having a second exhaust orifice area; and the first exhaust orifice area is larger than the second exhaust orifice area.

17. The method of claim 10 wherein the step of moving includes each valve being a proportional valve.

18. A method for exposing a workpiece comprising the steps of providing an illumination source that generates an illumination beam, and moving the workpiece relative to the illumination beam with the stage assembly of claim 10.

19. A stage assembly for positioning a workpiece along a movement axis, the stage assembly comprising:

a stage that is adapted to couple to the workpiece;

a base;

a fluid actuator assembly that is coupled to and moves the stage along the movement axis relative to the base, the fluid actuator assembly including (i) a piston housing that defines a piston chamber; (ii) a piston that is positioned within and moves relative to the piston chamber along a piston axis, the piston separating the piston chamber into a first chamber and a second chamber that are on opposite sides of the piston; and (iii) a first valve sub-assembly that controls the flow of a working fluid into the first chamber, the first valve sub-assembly including a plurality of first supply valves that control the flow of the working fluid into the first chamber, and a plurality of first exhaust valves that control the flow of the working fluid out of the first chamber;

a control system that controls the fluid actuator assembly to control the flow of the working fluid into and out of the first chamber; and a second valve sub-assembly that controls the flow of the working fluid into and out of the second chamber; wherein the second valve sub-assembly includes a plurality of second supply valves that control the flow of the working fluid into the second chamber, and a plurality of second exhaust valves that control the flow of the working fluid out of the second chamber.

20. A stage assembly for positioning a workpiece along a movement axis, the stage assembly comprising:

a stage that is adapted to couple to the workpiece;

a base;

a fluid actuator assembly that is coupled to and moves the stage along the movement axis relative to the base, the fluid actuator assembly including (i) a piston housing that defines a piston chamber; (ii) a piston that is positioned within and moves relative to the piston chamber along a piston axis, the piston separating the piston chamber into a first chamber and a second chamber that are on opposite sides of the piston; and (iii) a first valve sub-assembly that includes a first supply valve that controls the flow of the working fluid into the first chamber, and a first exhaust valve that controls the flow of the working fluid out of the first chamber;

wherein the first supply valve has a first supply orifice having a first supply orifice area, and the first exhaust valve has a first exhaust orifice having a first exhaust orifice area; wherein the first supply orifice area is different from the first exhaust orifice area; and a control system that controls the fluid actuator assembly to control the flow of the working fluid into and out of the first chamber, wherein the first valve sub-assembly includes a second supply valve that controls the flow of the working fluid into the first chamber; wherein the second supply valve has a second supply orifice having a second supply orifice area; and the second supply orifice area is larger than the first supply orifice area.

21. A method for positioning a workpiece along a movement axis, the method comprising:

providing a base;

coupling the workpiece to a stage;

moving the stage along the movement axis relative to the base with a fluid actuator assembly that includes (i) a piston housing that defines a piston chamber;

(ii) a piston that is positioned within and moves relative to the piston chamber along a piston axis, the piston separating the piston chamber into a first chamber and a second chamber that are on opposite sides of the piston; and (iii) a first valve sub-assembly that controls the flow of a working fluid into the first chamber, the first valve sub-assembly including a first supply valve that controls the flow of the working fluid into the first chamber, and a first exhaust valve that controls the flow of the working fluid out of the first chamber; wherein the first supply valve has a first supply orifice having a first supply orifice area, and the first exhaust valve has a first exhaust orifice having a first exhaust orifice area; wherein the first supply orifice area is different from the first exhaust orifice area; and controlling the fluid actuator assembly with a control system to control the flow of the working fluid into and out of the first chamber, wherein the step of moving includes the first valve sub-assembly having a second supply valve that controls the flow of the working fluid into the first chamber;

wherein the second supply valve has a second supply orifice having a second supply orifice area; and the second supply orifice area is larger than the first supply orifice area.

* * * * *